US007896111B2

(12) United States Patent
Slack

(10) Patent No.: US 7,896,111 B2
(45) Date of Patent: Mar. 1, 2011

(54) GRIPPING TOOL WITH DRIVEN SCREW GRIP ACTIVATION

(75) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 118 days.

(21) Appl. No.: 12/332,255

(22) Filed: Dec. 10, 2008

(65) Prior Publication Data

US 2009/0145594 A1 Jun. 11, 2009

Related U.S. Application Data

(60) Provisional application No. 61/012,730, filed on Dec. 10, 2007.

(51) Int. Cl.
*E21B 19/10* (2006.01)

(52) U.S. Cl. ..... 175/423; 166/77.52; 166/77.53

(58) Field of Classification Search ..... 175/423; 166/77.52, 77.53; 294/86.21, 86.23, 86.25–86.27, 294/86.3, 86.31
See application file for complete search history.

(56) References Cited

U.S. PATENT DOCUMENTS

2004/0216924 A1* 11/2004 Pietras et al. ..... 175/57
2009/0114398 A1* 5/2009 Buytaert et al. ..... 166/380

FOREIGN PATENT DOCUMENTS

| | | | |
|---|---|---|---|
| CA | 1242972 | A | 10/1988 |
| CA | 1285474 | C | 7/1991 |
| CA | 1299166 | C | 4/1992 |
| CA | 2271810 | A1 | 5/1998 |
| CA | 2286957 | A1 | 4/2000 |
| CA | 2345244 | A1 | 4/2000 |
| CA | 2399786 | A1 | 8/2001 |
| CA | 2301963 | A1 | 9/2001 |
| CA | 2427453 | A1 | 6/2002 |
| CA | 2122622 | C | 8/2004 |
| CA | 2469971 | A1 | 12/2004 |
| WO | 2006/116870 | A1 | 11/2006 |

* cited by examiner

*Primary Examiner*—Giovanna C Wright
(74) *Attorney, Agent, or Firm*—Christensen O'Connor Johnson Kindness PLLC

(57) ABSTRACT

A gripping tool having at least one body, including an associated load adaptor adapted to be connected to and interact with one of a drive head or reaction frame. A gripping assembly, carried by the body, has a grip surface adapted to move from a retracted position to an engaged position to radially engage one of an interior surface or an exterior surface of a work piece upon relative axial displacement of the body relative to the grip surface in at least one axial direction. A grip activation assembly acts between the body and the grip surface to increase a grip ratio of radial load upon the gripping assembly relative to axial displacement of the body relative to the grip surface. The grip activation assembly includes a motor driven load screw to create relative axial displacement of the body relative to the grip surface.

7 Claims, 6 Drawing Sheets

GRIPPING TOOL WITH DRIVEN SCREW GRIP ACTIVATION

FIELD OF THE INVENTION

This invention relates generally to applications where tubulars and tubular strings must be gripped, handled and hoisted with a tool connected to a drive head or reaction frame to enable the transfer of both axial and torsional loads into or from the tubular segment being gripped. In the field of earth drilling, well construction and well servicing with drilling and service rigs this invention relates to slips, and more specifically, on rigs employing top drives, applies to a tubular running tool that attaches to the top drive for gripping the proximal segment of tubular strings being assembled into, deployed in or removed from the well bore. This tubular running tool supports various functions necessary or beneficial to these operations including rapid engagement and release, hoisting, pushing, rotating and flow of pressurized fluid into and out of the tubular string.

BACKGROUND

Until recently, power tongs were the established method used to run casing or tubing strings into or out of petroleum wells, in coordination with the drilling rig hoisting system. This power tong method allows such tubular strings, comprised of pipe segments or joints with mating threaded ends, to be relatively efficiently assembled by screwing together the mated threaded ends (make-up) to form threaded connections between sequential pipe segments as they are added to the string being installed in the well bore; or conversely removed and disassembled (break-out). But this power tong method does not simultaneously support other beneficial functions such as rotating, pushing or fluid filling, after a pipe segment is added to or removed from the string, and while the string is being lowered or raised in the well bore. Running tubulars with tongs also typically requires personnel deployment in relatively higher hazard locations such as on the rig floor or more significantly, above the rig floor, on the so called 'stabbing boards'.

The advent of drilling rigs equipped with top drives has enabled a new method of running tubulars, and in particular casing, where the top drive is equipped with a so called 'top drive tubular running tool' or 'top drive tubular running tool' to grip and perhaps seal between the proximal pipe segment and top drive quill. (It should be understood here that the term top drive quill is generally meant to include such drive string components as may be attached thereto, the distal end thereof effectively acting as an extension of the quill.) Various devices to generally accomplish this purpose of 'top drive casing running' have therefore been developed. Using these devices in coordination with the top drive allows rotating, pushing and filling of the casing string with drilling fluid while running, thus removing the limitations associated with power tongs. Simultaneously, automation of the gripping mechanism combined with the inherent advantages of the top drive reduces the level of human involvement required with power tong running processes and thus improves safety.

In addition, to handle and run casing with such top drive tubular running tools, the string weight must be transferred from the top drive to a support device when the proximal or active pipe segments are being added or removed from the otherwise assembled string. This function is typically provided by an 'annular wedge grip' axial load activated gripping device that uses 'slips' or jaws placed in a hollow 'slip bowl' through which the casing is run, where the slip bowl has a frusto-conical bore with downward decreasing diameter and is supported in or on the rig floor. The slips then acting as annular wedges between the pipe segment at the proximal end of the string and the frusto-conical interior surface of the slip bowl, tractionally grip the pipe but slide or slip downward and thus radially inward on the interior surface of the slip bowl as string weight is transferred to the grip. The radial force between the slips and pipe body is thus axial load self-activated or 'self-energized', i.e., considering tractional capacity the dependent and string weight the independent variable, a positive feedback loop exists where the independent variable of string weight is positively fed back to control radial grip force which monotonically acts to control tractional capacity or resistance to sliding, the dependent variable. Similarly, make-up and break-out torque applied to the active pipe segment must also be reacted out of the proximal end of the assembled string. This function is typically provided by tongs which have grips that engage the proximal pipe segment and an arm attached by a link such as a chain or cable to the rig structure to prevent rotation and thereby react torque not otherwise reacted by the slips in the slip bowl. The grip force of such tongs is similarly typically self-activated or 'self-energized' by positive feed back from applied torque load.

In general terms, an embodiment of the "Gripping Tool" of WIPO Patent Application PCT/CA2006/000710 may be summarized as a gripping tool which includes a body assembly, having a load adaptor coupled for axial load transfer to the remainder of the body, or more briefly the main body, the load adaptor adapted to be structurally connected to one of a drive head or reaction frame, a gripping assembly carried by the main body and having a grip surface, which gripping assembly is provided with activating means to move from a retracted position to an engaged position to radially tractionally engage the grip surface with either an interior surface or exterior surface of a tubular work piece in response to relative axial movement or stroke of the main body in at least one direction, relative to the grip surface. A linkage is provided acting between the body assembly and the gripping assembly which, upon relative rotation in at least one direction of the load adaptor relative to the grip surface, results in relative axial displacement of the main body with respect to the gripping assembly to move the gripping assembly from the retracted to the engaged position in accordance with the action of the activating means.

This gripping tool thus utilizes a mechanically activated grip mechanism that generates its gripping force in response to axial load or stroke activation of the grip assembly, which activation occurs either together with or independently from, externally applied axial load and externally applied torsion load, in the form of applied right or left hand torque, which loads are carried across the tool from the load adaptor of the body assembly to the grip surface of the gripping assembly, in tractional engagement with the tubular work piece.

The grip surface of prior art gripping tools are generally comprised of a coarse profiled and hardened surface typical of tong dies known to the art, where such dies are designed to be sufficiently "sharp" so as to provide a consistent and reliable tractional engagement with the work piece for a gripping tool's grip ratio. Where grip ratio is defined as the normal force (radial load for tubulars) acting between the grip surface and the work piece divided by the magnitude of the shear force (arising from applied hoisting and torsional loads) and by definition must exceed the inverse of the effective coefficient of friction existing between the grip surface and the work piece to prevent slippage. "Sharper" dies, with less contact area, generally penetrate the work piece at lower normal forces providing a higher effective friction coefficient at the correlative lower hoisting load than "duller" dies but this has the side effect of causing greater indentation depth at greater loads leaving localized regions of plastic deformation on the surface of the work piece which are undesirable in certain applications.

As grip surfaces wear the die tooth tips become more rounded and the tooth tip area increases such that the effective coefficient of friction tends to decrease at the same normal stress. In addition, work pieces with hardened, inconsistent, or coated surfaces offer reduced coefficient and require a tool with a higher grip ratio or a more aggressive grip surface to safely run. Similarly a higher grip ratio is typically required at lower magnitudes of normal force. The present invention is directed to this need.

SUMMARY

In general terms the present invention is an improved gripping tool of the type generally described in PCT/CA2006/000710, with the improvement comprising the incorporation of one or more features to enhance the tool's grip ratio over some or all of the range of applied axial or torsional loads.

There is provided a gripping tool having at least one body, including an associated load adaptor adapted to be connected to and interact with one of a drive head or reaction frame. A gripping assembly is carried by the at least one body. The gripping assembly has at least one grip surface adapted to move from a retracted position to an engaged position to radially engage the grip surface with one of an interior surface or an exterior surface of a work piece upon relative axial displacement of the at least one body relative to the grip surface in at least one axial direction. A grip activation assembly acts between the at least one body and the grip surface and includes a motor driven load screw to create relative axial displacement of the at least one body relative to the grip surface and correlatively increases the grip ratio of radial engagement force of the grip surface relative to applied axial load.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

Externally Gripping (External Grip) Tubular Running Tool with Motor Driven Load Screw Activation

DESCRIPTION OF THE PREFERRED EMBODIMENTS

General Principles

Figure 1:
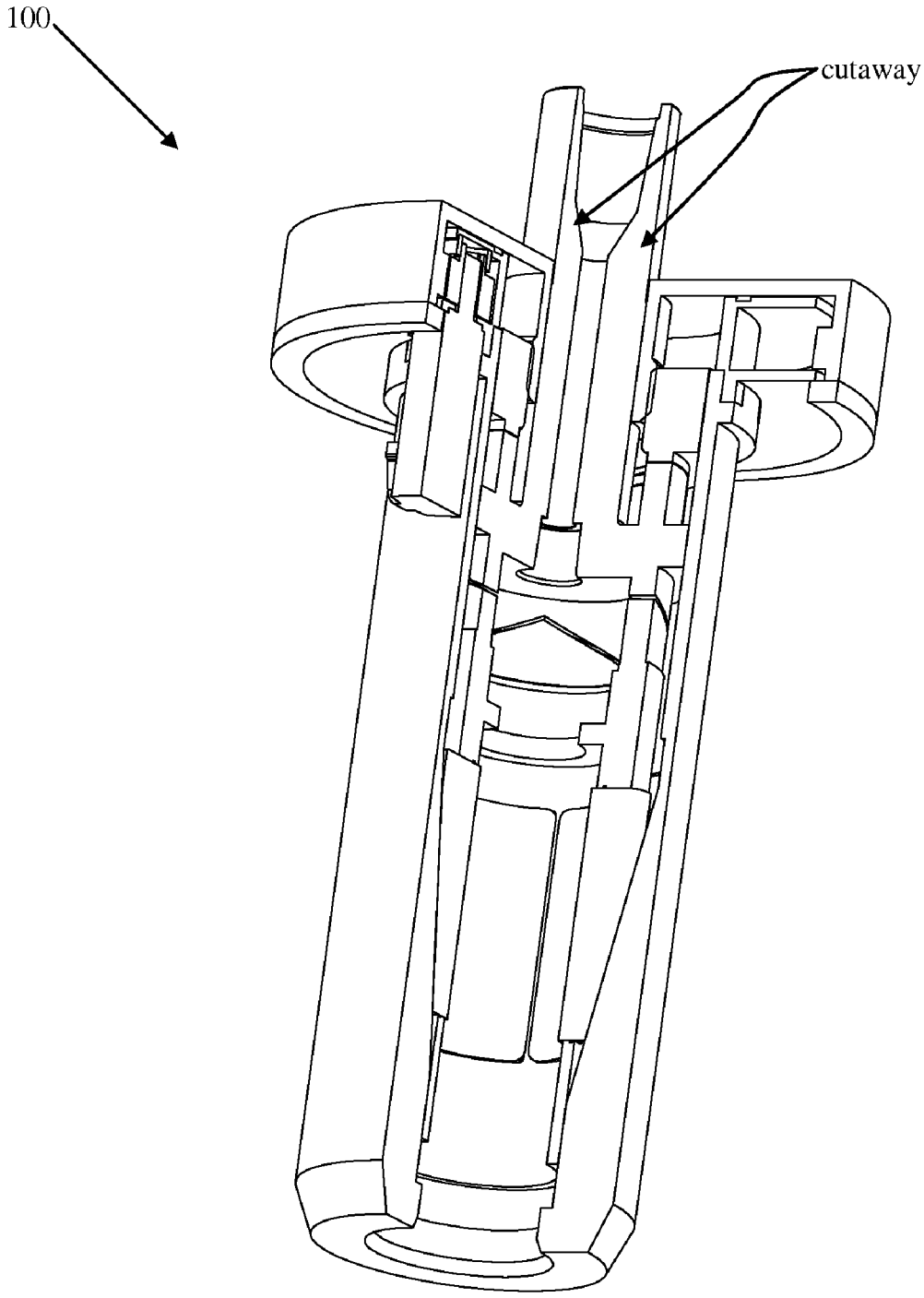
FIG. 1 is a partial cutaway trimetric view of a simplified version of a tubular running tool provided with an external bi-axially activated wedge-grip mechanism with a motor driven load screw activator in its base configuration architecture (latched position w/o casing)

The gripping tool described in PCT patent application CA 2006/00710,is comprised of three main interacting components or assemblies: 1) a body assembly, 2) a gripping assembly carried by the body assembly, and 3) a linkage acting between the body assembly and gripping assembly. The body assembly generally provides structural association of the tool components and includes a load adaptor by which load from a drive head or reaction frame is transferred into or out of the remainder of the body assembly or the main body. The gripping assembly, has a grip surface, is carried by the main body of the body assembly and is provided with means to radially stroke or move the grip surface from a retracted to an engaged position in response to relative axial movement, or axial stroke, to radially and tractionally engage the grip surface with a work piece. The gripping assembly thus acts as an axial load or axial stroke activated grip element.

The main body is coaxially positioned with respect to the work piece to form an annular space in which the axial stroke activated gripping assembly is placed and connected to the main body. The grip surface of the gripping assembly is adapted for conformable, circumferentially distributed and collectively opposed, tractional engagement with the work piece. The means to radially stroke the gripping surface carried by the gripping assembly is configured to link relative axial displacement, or axial stroke, in at least one axial direction, into radial displacement or radial stroke of the grip surface against the work piece with correlative axial and collectively opposed radial forces then arising such that the radial grip force at the grip surface enables reaction of applied axial load and torque into the work piece, where the distributed radial grip force is internally reacted, which arrangement comprises an axial load activated grip mechanism where axial load is carried between the drive head or reaction frame and work piece; the load adaptor, main body and grip element, generally acting in series.

The linkage acting between the body assembly and gripping assembly is adapted to link relative rotation between the load adaptor and grip surface into axial stroke of the gripping assembly and hence radial stroke of the grip surface. The axial load activated grip mechanism is thus arranged to allow relative rotation between one or both of axial load carrying interfaces between the load adaptor and main body or main body and grip element which relative rotation is limited by at least one rotationally activated linkage mechanism which links relative rotation between the load adaptor and grip surface into axial stroke of the grip element and hence radial stroke of the grip surface. The linkage mechanism or mechanisms may be configured to provide this relationship between rotation and axial stroke in numerous ways such as with pivoting linkage arms or rocker bodies acting between the body assembly and gripping assembly but can also be provided in the form of cam pairs acting between the grip element and at least one of the main body or load transfer adaptor to thus readily accommodate and transmit the axial and torsional loads causing, or tending to cause, rotation and to promote the development of the radial grip force. The cam pairs, acting generally in the manner of a cam and cam follower, having contact surfaces are arranged in the preferred embodiment to link their combined relative rotation, in at least one direction, into axial stroke of the grip element in a direction tending to tighten the grip, which axial stroke thus has the same effect as and acts in combination with axial stroke induced by axial load carried by the grip element. Application of relative rotation between the drive head or reaction frame and grip surface in contact with the work piece, in at least one direction, thus causes radial stroke or radial displacement of the grip surface into engagement with the work piece with correlative axial, torque and radial forces then arising such that the radial grip force at the grip surface enables reaction of torque into the work piece, which arrangement comprises torsional load activation so that together with the said axial load activation, the grip mechanism is self-activated in response to bi-axial combined loading in at least one axial and at least one tangential or torsional direction.

In one embodiment of the present invention the axial load activated grip mechanism of the improved gripping tool is further arranged to allow for a motor driven load screw to induce a relative axial movement between the main body of the body assembly and the grip assembly. This motor driven load screw assembly generally consists of, but is not limited to, a motor, a driven gear, and a load screw pair. This motor driven load screw assembly can be configured to provide relative axial displacement between the grip assembly and the main body in numerous ways, but is generally configured such the motor is rigidly attached to the main body and the driven gear is allowed to rotate relative to the main body but is fixed axially while one half of the load screw pair is fixed to the drive gear the other is fixed to one of the cams and allowed to move axially relative to the main body but is configured such that it is rotationally fixed to the main body. The result is that activation of the motor drives the grip assembly axially relative to the main body and thus induces radial displacement of the grip surface, moving it into contact with the work piece. This motor driven load screw mechanism is configured such that the axial load and torque activated gripping mechanisms remain active. The drive motors of the present invention are illustrated to be hydraulic motors and as such require hydraulic fluid supplied at pressure through a rotating seal assembly which is not illustrated, it is expected that the rotary seal assembly will be of standard commercially available design and is mounted to the motor mount as convenient for a given embodiment. (It is understood that it may be desirable to use drive motor of a different type and as such accommodations for supply of power to the motors through the rotating interface must be made regardless of power type.)

In brief, a stroke or axial force activated grip mechanism, where the axial component of stroke causes radial movement of the grip surface into tractional engagement with the work piece, provides a work piece gripping force correlative with axial force, which tractionally resists shear displacement or sliding between the work piece and the gripping surface. The tool provides a further rotation or torque activated linkage acting to stroke the grip surface in response to relative rotation induced by torque load carried across and reacted within the tool in at least one rotational direction, which rotation or torque induced stroke is arranged to have an axial component that causes the radial movement of the grip surface with correlative tractional engagement of the work piece and gripping force internally reacted between the work piece and grip mechanism structure.

The present invention provides an additional means to stroke the grip surface relative to the main body of the tool using a motor driven load screw. Activation of the motor causes an axial load to be applied to the grip assembly, which is reacted within the main body, and results in a relative axial movement of the grip assembly relative to the main body resulting in a radial movement of the grip surface with correlative tractional engagement of the work piece.

All of the embodiments of improved gripping tools subsequently described are defined by a single configuration architecture, where the term configuration architecture refers to the arrangement of the cams. It is understood that any of the improvements of the present invention can be applied to a gripping tool with any of the seven (7) cam architectures described in detail in PCT/CA2006/000710, now in the US national phase under U.S. patent application Ser. No. 11/912,656, filed Oct. 25, 2007.

External Grip Tubular Running Tool with Motor Driven Load Screw Activation

Figure 2:
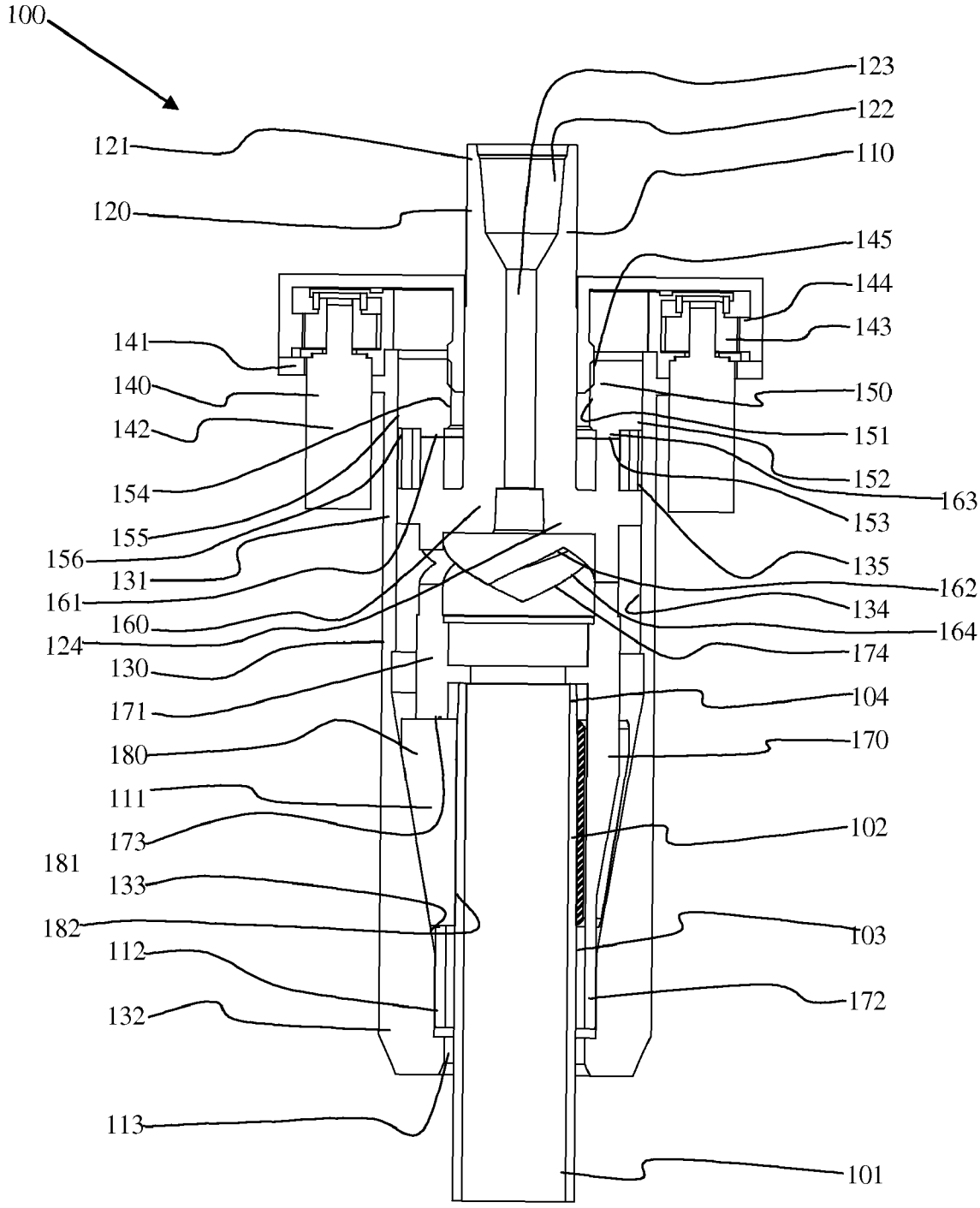
FIG. 2 is a cross-section view of a simplified version of a tubular running tool shown in FIG. 1 as it appears in its set position gripping the proximal end of a threaded and segment of casing Internally Gripping (Internal Grip) Tubular Running Tools with Motor Driven Load Screw Activation

Referring to FIGS. 1 and 2, there will now be described a preferred embodiment, of gripping tool, referred to here as an "external grip tubular running tool with motor driven load screw activation". Shown in a simplified form this external tubular running tool with motor driven load screw activation has its grip element provided as a wedge-grip and is incorporated into a mechanically set and unset tubular running tool, embodying the flat-cam configuration (4) torque activation architecture. This 'flat-cam configuration (4) wedge-grip' bi-axially activated tubular running tool with load screw activation is shown in FIG. 1, generally designated by the numeral 100, where it is shown in an trimetric partial cut-away view as it appears configured to grip on the external surface of a tubular work piece, hence this configuration is subsequently referred to as an external grip tubular running tool. Referring now to FIG. 2, this external grip tubular running tool 100 of the preferred embodiment is shown in relation to tubular work piece 101 as it is configured for running casing strings comprised of casing joints or pipe segments joined by threaded connections arranged to have a 'box up pin down' field presentation, where the most common type of connection is referred to as threaded and coupled. Work piece 101 is thus shown as the upper end of a piece of casing having a pipe body 102 with exterior surface 103 and upper end 104. It is understood that generally the work piece 101 will consist of mill end connection, including a coupling which is preassembled to the threaded proximal end of a joint of casing, but for illustration purposes this simplified version of the external grip tubular running is shown engaging a piece of casing with no end connection style indicated. It will be apparent to one skilled in the art that the tool can be modified by increasing the internal dimensions radially and/or axially as required to accommodated any desired coupling style. The presence of a coupling on the upper end of the work piece is not an essential requirement for the functioning of this embodiment of the present invention as a tubular running tool.

Referring still to FIG. 2, tubular running tool 100 is shown in its activated position, as it appears when engaged with and gripping tubular work piece 101 and configured at its upper end 110 for connection to a top drive quill, or the distal end of such drive string components as may be attached thereto, (not shown) by load adaptor 120. Load adaptor 120 connects a top drive to an external bi-axially activated gripping element assembly 111 having at its lower end 112 an interior opening 113 where the external gripping interface is located and into which interior opening 113 the upper the proximal end 104 of a tubular work piece 101 is inserted and coaxially located. Load adaptor 120 is generally axi-symmetric and made from a suitably strong material. It has an upper end 121 configured with internal threads 122 suitable for sealing connection to a top drive quill, with internal through bore 123.

Referring still to FIG. 2, main body 130 is generally cylindrical in shape and comprised of upper end 131 and lower end 132 with internal frusto-conical surface 133. Main body 130 is rigidly connected to the motor drive assembly 140 at upper end 131. The motor drive assembly 140 is comprised of a motor mount flange 141, a plurality of drive motors 142 and pinion gears 143 (in this case two), and ring gear 144. The pinion gears 143 are rigidly connected to the drive motors 142, which are mounted to the motor mount flange 141. Ring gear 144 meshingly engages with pinion gears 143 and slidingly engages with motor mount flange 141 to prevent relative axial movement. A thread cam 150 is provided that has internal surface 151, external surface 152 and bottom cam face 153. The external surface 152 of thread cam has a plurality of axially oriented splines 155 which slidingly engage with mating axial splines 135 on the internal surface 134 of main body 130, forming guide spline pair 156. Load screw 145 on ring gear 144 threadingly engages with load screw 154 on the inside surface 151 gear cam 150. Dual cam 160 with upper cam face 161 and lower cam face 162 is rigidly attached to the lower end 124 load adaptor 120. The bottom cam face 153 of thread cam 150 slidingly engages the upper cam face 161 of dual cam 160, and collectively form the upper cam pair 163. A cage 170 is provided with upper end 171, lower end 172. A plurality of radially oriented windows 173, in this case five (5), are provided in the bottom end 172 of cage 170. Upper end 171 of cage 170 is provided with cam profile 174. The lower cam face 162 of dual cam 160 slidingly engages with cam profile 174 on the upper end 171 of cage 170 and collectively form the lower cam pair 164. In this case the cam pairs 163 and 164 are shown in the flat-cam configuration arrangement with a simple saw tooth cam profile. The present invention is provided with a plurality of jaws 180, in this case five (5), with outer frusto-conical segment surface 181, inner cylindrical surface 182, upper end 183 and lower end 184. The jaws 180 are assembled in windows 173 of cage 170 such that the outer surface 181 slidingly engages with inner frusto-conical surface 133 of main body 130. The inner substantially cylindrical surface 182 of jaw 180, with a coarse profiled and hardened surface finish typical of tong dies, designed to increase friction and improve wear characteristics, the inner surfaces 182 of jaws 180 collectively form the gripping surface 183 which tractionally engages outer surface 103 of work piece 101. While the gripping surface 183 in this case is shown to be integral with the jaws 180 to form a so-called jaw-die, it is understood that it may be desirable to have a separate "die" component which is rigidly attached to the inner cylindrical surface of the jaw 180 and in either case the grip element assembly 111 tractionally engages the exterior surface 103 of work piece 101. The external tubular running tool with motor driven load screw activation 100 is designed such that activation of drive motors 142 will result in the axial movement of thread cam 150 relative to main body 130 along guide spline pair 156. Driving thread cam 150 axially downwards relative to main body 130 will bring upper cam pair 163 and lower cam pair 164 together and subsequently push cage 170 downward relative to main body 130. The jaws 180, which are axially constrained within the windows 173 of cage 170 move down the internal frusto-conical surface 133 of main body 130 consequently move radially inwards until inner surface 182 makes contact with and tractionally engages outer surface 103 of work piece 101. Driving thread cam 150 axially upwards will allow the dies to become disengaged from the casing. It is understood that the preferred embodiment of the present invention is not limited to the cam profiles illustrated and that other cam profiles or arrangements can used in this embodiment the tool. It will be understood by one skilled in the art that, while not shown in this simplified configuration, the jaws are required to be retracted on reversal of the drive motors. As such any one of an number of mechanical means can be used to retract the jaws which include but are not limited to keying the jaw to the frusto-conical internal surface of the main body or providing a radially acting spring attached to the jaws.

Figure 3:
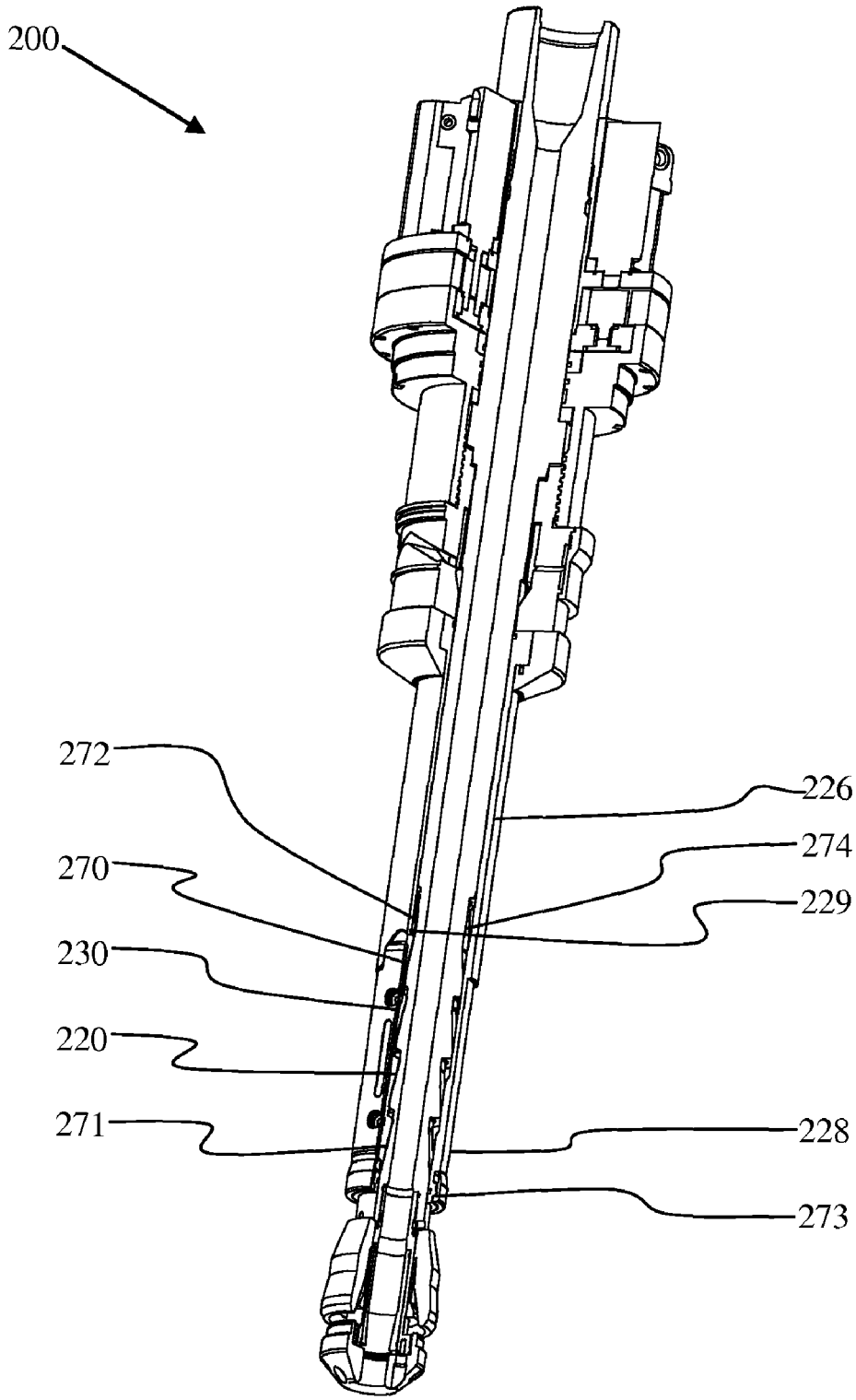
FIG. 3 is a partial cutaway trimetric view of a tubular running tool provided with an internal bi-axially activated wedge-grip mechanism with a motor driven load screw activator in its base configuration architecture (latched position w/o casing).
Figure 4:
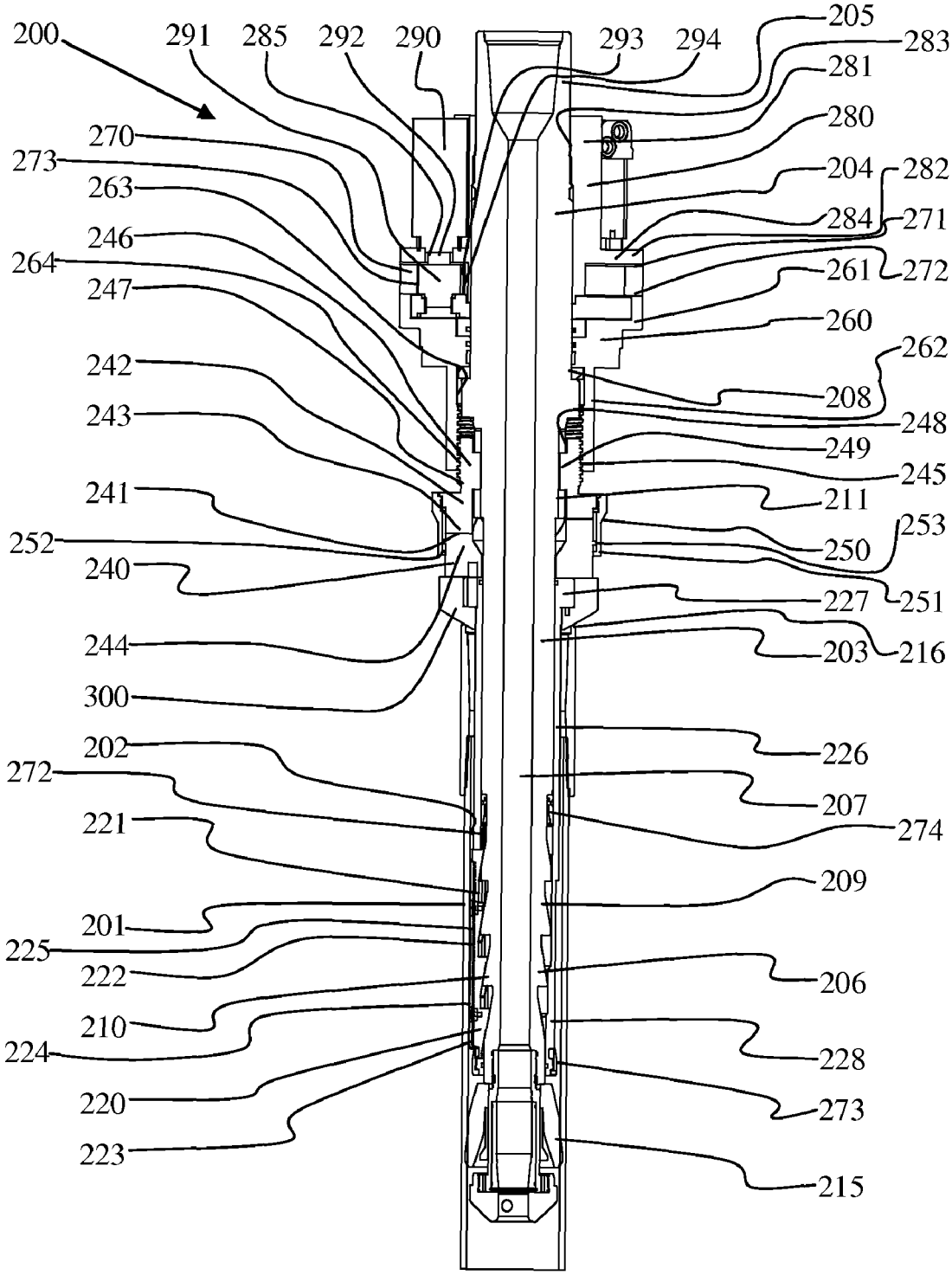
FIG. 4 is a cross-section view of an internal grip tubular running tool shown in FIG. 3 as it appears set on the proximal end of a threaded and coupled segment of casing.

Internal Gripping Tubular Running Tool Incorporating an Axi-Symmetric Wedge Grip with Motor Driven Load Screw Activation In an alternative embodiment, this 'base configuration wedge-grip' bi-axially activated tubular running tool with motor driven load screw activation is provided in an internally gripping configuration, as shown in FIGS. 3 and 4, and generally designated by the numeral 200. Referring now to FIG. 3 where the tool is shown in a trimetric partially sectioned view as it appears configured to grip on the internal surface of a tubular work piece, thus also referred to here as an internal grip tubular running tool. This alternate configuration shares most of the features of the external grip tubular running tool of the preferred embodiment already described; therefore it will be described here more briefly.

Referring now to FIG. 4, internal grip tubular running tool 200 is shown inserted into work piece 201 and engaged with its interior surface 202; having an elongate generally axi-symmetric mandrel 203, which in this configuration functions as the main body. Mandrel 203 having an upper end 204, in which load adaptor 205 is integrally formed, a lower end 206, a centre through bore 207 and a generally cylindrical external surface 208 except where it is profiled to provide ramp surface 209 distributed over a plurality of individual frusto-conical intervals 210 here shown as four (4), and splined interval 211.

Referring still to FIG. 4, a plurality of circumferentially distributed and collectively radially opposed jaws 220, shown here as five (5), are disposed around ramp surface 209; jaws 220 have internal surfaces 221 profiled to generally mate to and slidingly engage with ramp surface 209, and external surfaces 222, typically provided with rigidly attached dies 223; dies 223 having external surfaces 224 collectively forming grip surface 225 configured with a shape and surface finish to mate with and provide effective tractional engagement with the interior surface 202 of work piece 201, such as provided by the coarse profiled and hardened surface finish, typical of tong dies. Generally tubular cage 226, having upper and lower ends 227 and 228 respectively, is coaxially located between the exterior surface 208 of mandrel 203 and interior surface 202 of work piece 201. Referring now to FIG. 3, cage 226 having windows 229 in its lower end 228 in which the jaws 220 are placed and thus axially and tangentially aligned, the assembly of jaws 220 and cage 226 forming wedge-grip element 230. The cage 226 together with jaws 220 collectively form the grip assembly.

Jaws 220 can also be retained where the jaws having upper and lower ends 270 and 271 respectively are provided with retention tabs 272 extending upward on their upper ends 270, and referring now to FIG. 4, where the retention tabs 272 are arranged to engage the inside of cage 226 when the jaws 220 are installed in windows 229 and are positioned at their intended limit of radial extension; and at their lower ends 271 to be similarly retained by retainer ring 273 attached to and carried on the lower end 228 of cage 226 overlapping with lower ends 271 of jaws 220. As a further means to urge retraction of the jaws, split ring 274 is provided attached to mandrel 203 above ramp surface 209 and trapped inside cage 226 and arranged so that when relative downward axial movement of the mandrel 203 required to retract the jaws 220 occurs, retention tabs 272 slide under split ring 274 tending to force jaws 220 inward.

Referring still to FIG. 4, upper end 227 of cage 226 is rigidly attached to generally tubular cage cam 240 having upward facing profiled end surface 241. Thread cam 242 is similarly tubular with downward facing profiled end surface 243 generally interacting with the upward facing profiled surface 241 of cage cam 240 to act as a cam pair 244 providing torque activation. Thread cam 242 has load thread 245 on the outer surface 247 at the generally tubular upper end 246 and axially oriented guide splines 249 on inner surface 248. The axially oriented guide splines 249 of thread cam 242 are designed such that they mesh with and are assembled such that they slidingly engage with guide spline interval 211 near the center of the external surface 208 of mandrel 203. Cam pair 244 has external latch housing 250 which is generally tubular in shape and rigidly attached to the outside surface 247 of thread cam 242, the lower end 251 of external latch housing 250 slidingly engages the outside surface 251 of cage cam 240 and provides a positive axial stop such that upward facing internal upset surface 252 of external latch housing 250 engages with the downward facing external upset surface 253 on cage cam 240 so that the axial separation of cam pair 244 is limited. While external latch housing 250 is illustrated in this case to function solely as a axial stop/latch, it is understood that it may be desirable to have an air spring acting between the cam faces of cam pair 244, and as such the external latch housing 250 can be adapted to provide an air reservoir and to sealingly and slidingly engage with cage cam 240. As such air pressure in this reservoir will act to provide some initial die engagement and improve the grip ratio of the tool at low hoisting loads.

Referring still to FIG. 4, drive screw 260 with upper end 261, lower end 262 and internal surface 263, is assembled coaxially with mandrel 203 and located above cam pair 244. Lower end 262 of drive screw 260 has thread element 264 on internal surface 263, which threadingly engages with load thread 245 on the outer surface 247 of thread cam 242. The upper end 261 of drive screw 260 is rigidly attached to ring gear 270, which has upper end 271, lower end 272 and internal geared surface 273. The tubular running tool of the present invention is provided with motor mount 280 that has upper end 281, lower end 282, internal surface 283 and external flange 284 with a plurality of mounting holes 285, in this case five (5). The motor mount 280 is assembled coaxially with mandrel 203 above drive screw 260 and the internal surface 283 is rigidly attached to the external surface 208 of mandrel 203. A plurality of drive motors 290 and pinion gears 291 are provided, in this case five (5). The drive motors 290 are rigidly attached to mounting holes 285 on the external flange 284 of motor mount 280. Pinion gear 290 is rigidly attached to and coaxially mounted to the motor shaft 292 of drive motor 290, and has gear teeth 293 on external surface 294 which meshingly engage with gear teeth on the internal surface 273 of ring gear 270. Bump ring 300 is attached to the upper end 227 of cage 226 and is dimensioned to act as a land or stop for the proximal end 216 of work piece 201. The lower end 206 of mandrel 203 is provided with an annular seal 215, shown here as a packer cup, sealingly engaging with the internal surface 202 of work piece 201, thus providing a sealed fluid conduit from the top drive quill through bore 207 of mandrel 203 into the work piece 201, to support filling and pressure containment of well fluids during casing running or other operations. In addition, flow control valves such as a check valve, pressure relief valve or so called mud-saver valve (not shown), may be provided to act along or in communication with this sealed fluid conduit.

Thus configured, interior gripping tubular running tool 200, functions in a manner very similar to that already described in the preferred embodiment of exterior gripping tubular running tool 100, where it is unlatched and set by forward activation of the drive motors and latched by reverse activation of the drive motors. Once set the tool activates in a fully mechanical manner with biaxial activation, referring still to FIG. 4, the tool is shown as it would appear under application of right hand torque causing rotation and activation of the cam pair 244.

Figure 5:
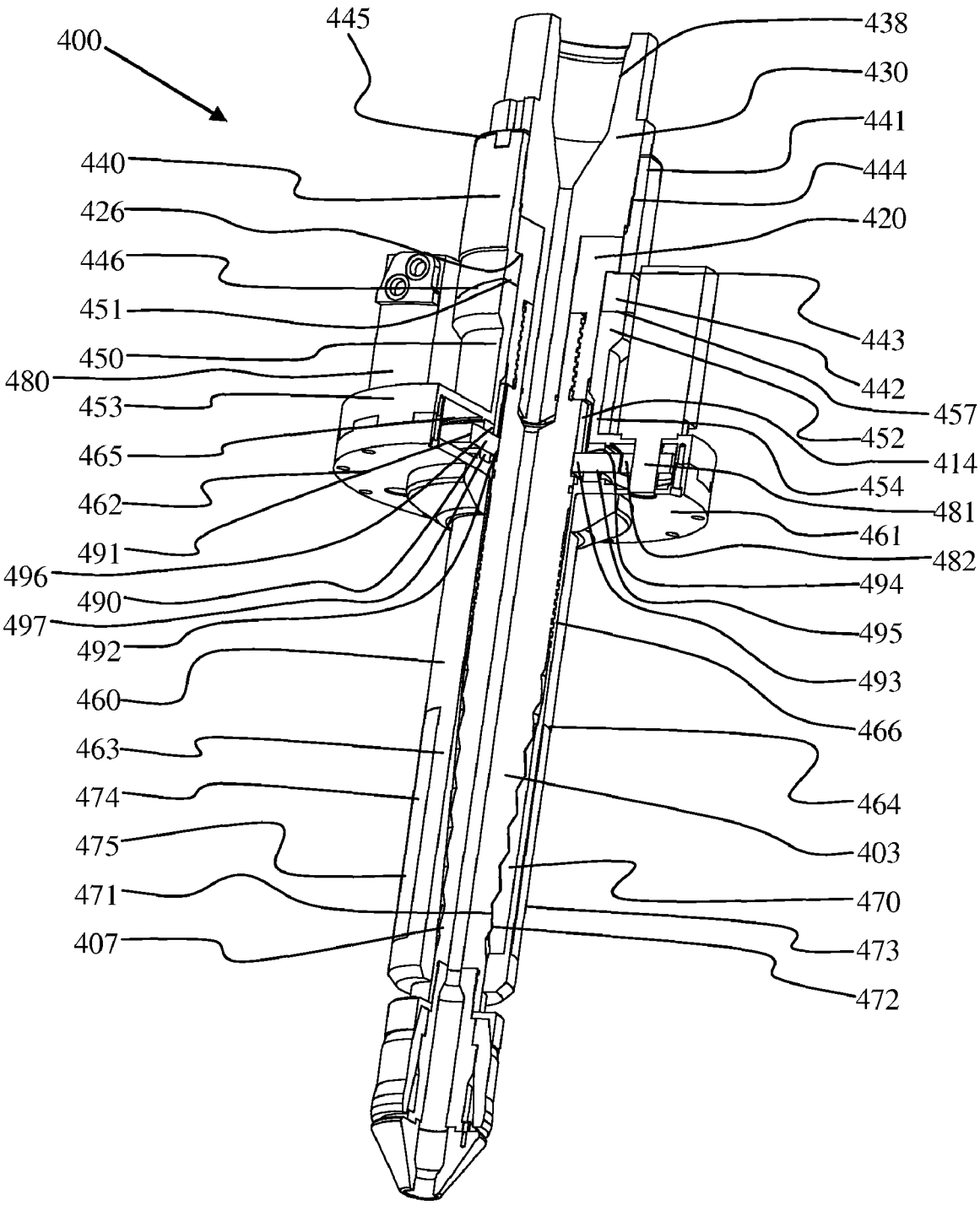
FIG. 5 is a partial cutaway trimetric view of a tubular running tool provided with an internal bi-axially activated helical wedge-grip mechanism with a motor driven load screw activator in its base configuration architecture (latched position w/o casing).
Figure 6:
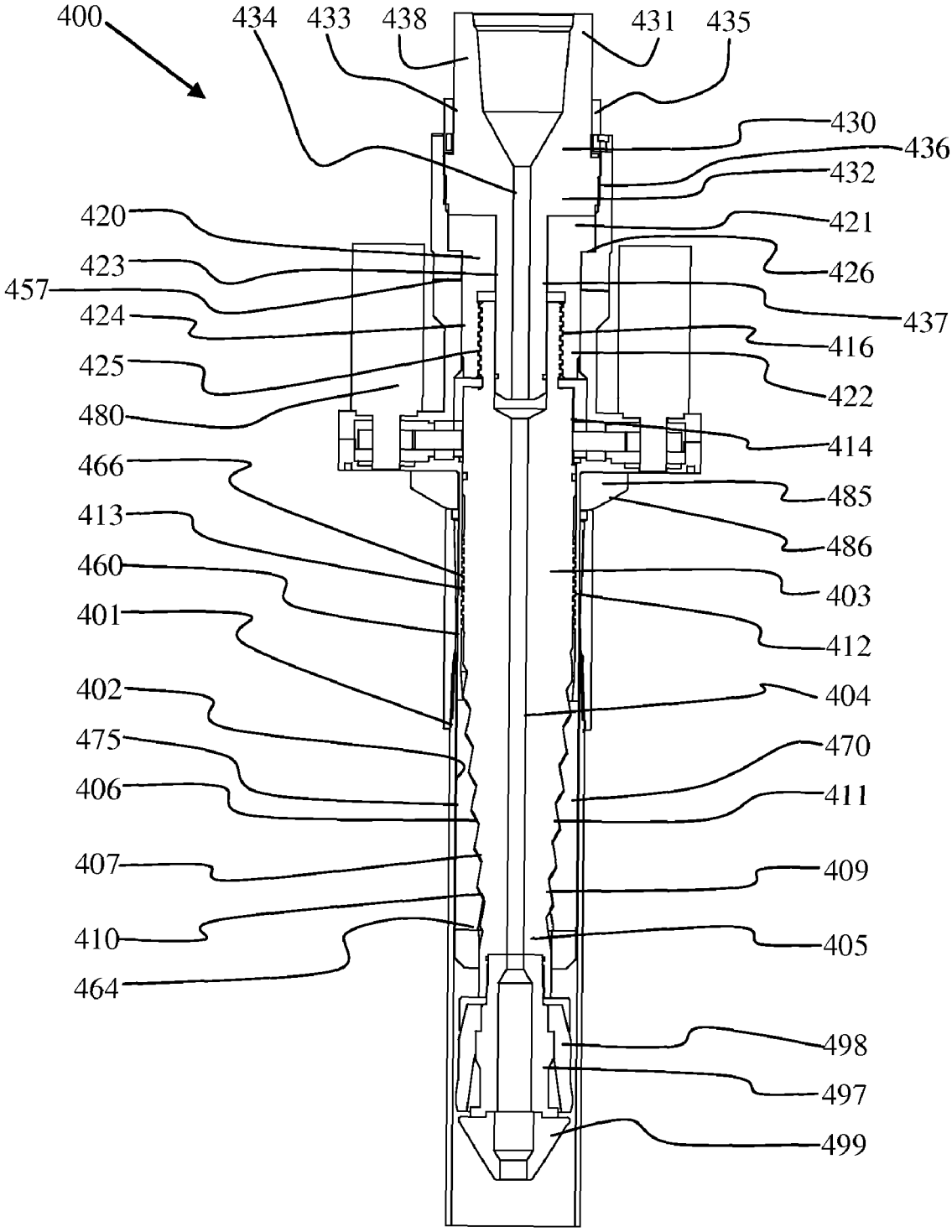
FIG. 6 is a cross-section view of an internal grip tubular running tool shown in FIG. 5 as it appears set on the proximal end of a threaded and coupled segment of casing.

Internal Gripping CRT Incorporating Helical Wedge Grip with Motor Driven Load Screw Activation In an alternative embodiment of the present invention, the bi-axially activated internally gripping tubular running tool with motor driven load screw activation is configured to have a helical wedge grip. This variant embodiment is illustrated in FIGS. 5 and 6 as an internal gripping bi-axially activated tubular running tool employing a torque activation architecture single cam pair characterized and generally designated by the numeral 400. Referring now to FIG. 5 where the tool 400 is shown in a trimetric partially sectioned view as it appears retracted and configured to insert into a tubular work piece. This alternative configuration shares many of the features of the internally gripping axi-symmetric wedge grip tubular running tool with motor driven load screw activation of embodiment 200 previously described, therefore it will be described here with emphasis on the different architectural features.

Referring now to FIG. 6, which shows tubular running tool 400 as it would appear inserted into work piece 401 and engaged with its interior surface 402; having an elongate mandrel 403, which in this configuration functions as the main body. Mandrel 403 made from a suitably strong and rigid material and having a centre through bore 404, a lower end 405, and having an interval above the lower end 405 of generally increasing diameter and comprised of dual ramp surface interval 406, characterized by a helical profile 407 which tapers inward towards the lower end 405 of mandrel 403 and is generally shaped as a tapered thread form with lead, taper, helix direction, load flank angle and stab flank angle all selected in accordance with the needs of a given application, but shown here in the preferred embodiment as a right hand V-thread formed by load and stab flank surfaces 409 and 410 respectively together forming dual ramp surface 411, where the load and stab flank angles or axial radial flank tapers are selected to be similar to those typically employed for the frusto-conical surfaces of slips. Above the dual ramp surface is a cage thread interval 412 in which are placed external carrier threads 413 having a lead matching that of helical profile 407. Above the cage thread interval 412 is an axial splined interval 414, and above that are the load thread element 416 with a lead also matching that of helical profile 407.

Referring again to FIG. 6, tubular running tool 400 has mandrel carrier ring 420 with upper end 421 lower end 422, internal bore 423 and external surface 424. Load thread 425 at the lower end 422 of mandrel carrier ring 420 on the internal bore 423, threadingly engages the load thread element 416 on upper end of mandrel 403. Load shoulder 426 is located at the upper end 421 on the external surface 424 of mandrel carrier ring 420. Upper nubbin 430 with upper end 431, lower end 432 outer surface 433 and inner bore 434, has splined interval 435 and threaded interval 436 on outer surface 433, stinger 437 at lower end 432 and load adaptor 438 at upper end 431 which is designed to threadingly and sealingly engage with the top drive quill. Referring now to FIG. 5, upper cam ring 440 with upper end 441, lower end 442, has interior shoulder 443, interior threaded interval 444 and torque dogs 445 at upper end 441. The lower face 442 of upper cam ring 440 consists of cam profile 446, which in this case is shown to be a symmetric saw tooth profile, although it is understood that it may be desirable to use a different profile. The interior shoulder 443 of upper cam ring 440 is assembled such that it contacts and slidingly engages downward facing shoulder 426 of mandrel carrier ring 420 and as such completes the primary hoisting load path between the load adaptor 438 on upper nubbin 430 and the grip element 475 on jaws 470.

Referring still to FIG. 5, tubular running tool 400 is provided with lower cam ring 450 with cam profile 451 at upper end 452 and is rigidly connect to, in this case integrally formed with, motor mount flange 453 at lower end 454. Lower cam ring 450 is assembled coaxially with and adjacent to upper cam ring 440 such that cam profiles 451 and 446 respectively slidingly engage one another collectively forming cam pair 457. Cage 460 with is rigidly connect to, in this case integral with, gear housing flange 461 at upper end 462, is generally tubular in shape with elongate lower interval 463, carrier thread element 466 and a plurality of radially oriented windows 464, in this case five (5), which are evenly spaced around the circumference. The upper end 462 of cage 460 is rigidly connected to motor mount flange 453 of lower cam ring 450 collectively forming a gear housing cavity 465. A plurality of drive motors 480, in this case two (2) are located on and rigidly attached to the upper face 455 of motor mount flange 453, such that the drive shaft 481 of motor 480 passes through the motor mount flange and is rigidly connected to pinion gear 482 in gear housing cavity 465. Drive gear 490 with outside surface 491 and inside surface 492, has guide splines 493 on inside surface 492, which slidingly engage with and restrict relative circumferential displacement relative to splined interval 414 on mandrel 403. Outside geared surface 491 meshingly engages with pinion gear 482. Drive gear 490 is assembled such that upper surface 494 and lower surface 495 engage respectively with thrust bearing elements 496 and 497 and react axial load to hold the drive gear 490 axially stationary relative to the cage 460. A plurality of jaws 470, equal to the number of windows 464 in cage 460, in this case five (5), with an interrupted tapered helical profile 471 on inner surface 472 designed to mate with tapered helical profile 407 of mandrel 403, has grip surface 473 on outer surface 474. In this case grip=surface 473 is shown to be integral to the jaw 470 and collectively form grip element 475. The jaws 470 and cage 460 collectively form the grip assembly.

Referring again to FIG. 6, the bottom end assembly 497 which in this case includes a packer cup 498 facilitates sealing against the inside surface 402 of work piece 401. Also provided in the bottom end assembly 497 is stabbing guide 499 which facilitates alignment of the tool with and subsequent insertion of the tool into the proximal end of work piece 401.

Referring again to FIG. 6, which shows a cross section view of the bi-axially activated internally gripping tubular running tool with motor driven load screw activation and helical wedge grip. The tubular running tool 400 is shown inserted into and tractionally engaged with work piece 401 such that the lower face 486 of bump ring 485 is in contact with the proximal end of the work piece 401. Drive motors 480 have been activated resulting in mandrel 403 being driven helically downward such that the jaws 470 are displaced radially outwards sufficiently for grip surface 473 to engage the inside surface 402 of work piece 401. Right hand torque has also been applied to the load adaptor sufficiently so that cam pair 457 is engaged, resulting in an axial downward movement of the cage 460 such that the jaws 470 are moved downward relative to mandrel 403 and radially outward by contact with window 464 in cage 460. The movement of the cage relative to the mandrel is allowed by providing sufficient backlash between carrier thread 413 of mandrel 403 and carrier thread 466 of cage 460.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

I claim:

1. A gripping tool, comprising:

at least one body including an associated load adaptor adapted to be connected to and interact with one of a drive head or reaction frame;

a gripping assembly carried by the at least one body, having at least one grip surface adapted to move from a retracted position to an engaged position to radially engage the grip surface with one of an interior surface or an exterior surface of a work piece upon relative axial displacement of the at least one body relative to the grip surface in at least one axial direction;

a grip activation assembly carried by and acting between the at least one body and the grip assembly to create relative axial displacement of the at least one body relative to the grip surface and correlatively increase a grip ratio of radial engagement force of the grip surface relative to applied axial load over at least some range of axial load, wherein the grip activation assembly includes a first load screw body and a second load screw body forming a load screw pair; and a linkage acting between the first load screw body and the second load screw body to cause relative rotation and react torque, torque being reacted solely through the linkage, the linkage including:

a drive motor to cause rotation of the first load screw body relative to the second load screw body; and an axially extending engagement to accommodate relative axial movement of the first load screw and the second load screw within the linkage while transferring and reacting torque.

2. The gripping tool of claim 1, wherein a driven gear is driven by the drive motor, the first load screw body depending from and rotating with the driven gear.

3. The gripping tool of claim 1, wherein the axial engagement is a splined engagement between the second load screw body and the at least one body.

4. The gripping tool of claim 1, wherein a cam surface on the second load screw body engages a cam surface on the grip assembly.

5. The gripping tool of claim 1, wherein the at least one body has an internal frusto-conical surface and rotation of the first load screw body results in axial movement of the second load screw body driving the second load screw body downward relative to the at least one body to move the gripping assembly down the internal frusto-conical surface of the at least one body forcing the grip surface radially inward.

6. The gripping tool of claim 1, wherein the at least one body includes a mandrel with an external surface having a ramp surface, the second load screw body being coaxial with the mandrel and the axial engagement being on the external surface of the mandrel and an internal surface of the at least one body, wherein rotation of the first load screw results in axial movement of the gripping assembly along the external surface of the mandrel with the ramp surface forcing the grip surface radially outward.

7. The gripping tool of claim 1, wherein the at least one body includes a mandrel that serves as the second load screw, the mandrel having an external surface with a splined interval that provides the axial engagement and a load thread interval, the splined interval engaging splines positioned on the inside surface of a drive gear driven by the drive motor to rotatably couple the mandrel to the drive gear while permitting relative axial movement, and wherein axial movement of the mandrel acts upon the grip assembly.

* * * * *